US007434633B2

(12) United States Patent
Lynde et al.

(10) Patent No.: US 7,434,633 B2
(45) Date of Patent: Oct. 14, 2008

(54) RADIALLY EXPANDABLE DOWNHOLE FLUID JET CUTTING TOOL

(75) Inventors: Gerald D. Lynde, Houston, TX (US); Mary L. Laird, Breaux Bridge, LA (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 11/522,692

(22) Filed: Sep. 18, 2006

(65) Prior Publication Data

US 2008/0066913 A1 Mar. 20, 2008

(51) Int. Cl.
*E21B 43/11* (2006.01)

(52) U.S. Cl. ..... 175/67; 175/424; 166/55.8

(58) Field of Classification Search ..... 175/67, 175/424; 166/55.8
See application file for complete search history.

(56) References Cited

U.S. PATENT DOCUMENTS 2,018,285 A * 10/1935 Schweitzer et al. ..... 166/292
5,181,578 A 1/1993 Lawler
5,363,927 A * 11/1994 Frank ..... 175/67
5,381,631 A 1/1995 Raghavan et al.
5,445,220 A 8/1995 Gurevich et al.
5,765,756 A 6/1998 Jordan et al.
6,155,343 A 12/2000 Nazzal et al.
2002/0050409 A1 * 5/2002 Nackerud ..... 175/67
2007/0151766 A1 * 7/2007 Butler et al. ..... 175/67

* cited by examiner

*Primary Examiner*—William P Neuder
(74) *Attorney, Agent, or Firm*—Greenberg Traurig LLP; Anthony F. Matheny

(57) ABSTRACT

Downhole fluid jet cutting tools having extendible and retractable arms with cutting heads on the ends are disclosed. The jet cutting tools permit casing and other downhole surfaces to be cut utilizing a cutting fluid forced through a jet nozzle assembly. Movement of a piston slidingly engaged within the passageway of the tool actuates the arms when cutting fluid pressure acts on the piston. As a result, the arms are extended and cutting fluid is forced at high pressure from the passageway to the cutting head where it is expelled through nozzles for cutting casing and the like. The jet cutting tools permit the arms to be extended, retracted, and re-extended or redeployed multiple times without the need for being retrieved from the wellbore.

19 Claims, 3 Drawing Sheets

RADIALLY EXPANDABLE DOWNHOLE FLUID JET CUTTING TOOL

BACKGROUND

1. Field of Invention

The present invention is directed to a downhole cutting tool and, in particular, a downhole radially expandable fluid jet cutting tool.

2. Description of Art

Various types of cleaning or cutting jet blasting arrangements have been proposed and used for jet blasting or eroding surfaces with abrasive fluids including, by way of example only, steam, water or any other fluid along with or without an abrasive substance in an attempt to accomplish whatever results may be desired.

Generally the fluids are conducted through a fluid passage in the arrangement and discharged through a restricted orifice in a jetting nozzle to increase the velocity of fluids and abrasive particles in an attempt to increase the cutting or cleaning effect desired. The jetting nozzle is available in a variety of designs and sizes and is normally produced from an extremely hard and/or tough material such as, by way of example only, carbide. It is generally accepted that the closer a jetting nozzle is to the surface to clean or cut the higher the efficiency of the operation.

One such prior jetting tool apparatus is disclosed in U.S. Pat. No. 5,765,756. The jetting tool apparatus of this patent includes multiple extendible telescoping jetting nozzles that are rotated into position by fluid flowing through the tool. In addition to rotation, the jetting nozzles extend telescopically so as to come in close contact with the cutting surface. After the cutting is completed, however, the nozzles remain extended. They are rotated downward into recesses to facilitate movement of the tool out of the wellbore. In those instances where the tool is to be moved to a new location for continued jetting, the telescopically extended jetting nozzles can not be reconfigured to a lesser extension because the telescoping members cannot be retracted to their original positions. As a result, the tool in U.S. Pat. No. 5,765,756 is limited in its use and requires removal of the tool from the well and resetting of the telescoping jetting nozzles before the tool can be used in a new, narrower, location. As is apparent, removal of the tool for resetting and subsequent repositioning in the well is time consuming and costly.

SUMMARY OF INVENTION

The present invention overcomes the deficiencies of U.S. Pat. No. 5,765,756 while providing additional benefits not found in prior jet cutting tools. For example, the jet cutting tools and methods of cutting a surface of a wellbore of the present invention provide the capability to extend and retract the jetting nozzles for easy and quick relocation and redeployment within a well without the need for removal of the tool from the well; permit the jetting nozzles to be consistently extended to the cutting surface; maintain the jetting nozzles in the appropriate orientation during cutting; permit easy and efficient cutting of casing when passing through a restriction in the casing or when cutting a surface in relatively shallow water depth; permit efficient cutting in multiple locations within conduits having variable inner diameters; and provide the capability of cutting in large diameter conduits and then be redeployed for cutting in small diameter conduits without having to remove the tool from the wellbore.

Broadly, the present invention is directed to a jet cutting tool having one or more arms that are extendable radially from the body of the tool. Each arm is in fluid communication with a passageway within the tool. An actuating member, such as a piston, is disposed within the passageway. Each arm includes a cutting head disposed on the end. The cutting head may include a metal cutting element such as crushed carbide or other carbide elements. Cutting fluid, such as an abrasive slurry known to persons skilled in the art, is pumped at high pressure down the passageway and moves the piston. The piston in turn extends each of the arms until each arm is in contact with the inner wall surface of the cutting surface or casing of the well. Cutting fluid is also forced into a length of tubing in fluid communication with the passageway and the cutting head. After extension of the arms to the point where the piston is no longer movable by the cutting fluid, the cutting head is positioned next to, and preferably in contact with, the cutting surface. The cutting fluid is then forced through the length of tubing from the passageway to the cutting head and out of the nozzle at a high pressure. The high pressure of the cutting fluid being expelled from the nozzle of the cutting head cuts the casing or other cutting surface.

After cutting, the pressure of the cutting fluid flowing through the passageway is decreased and the piston is retracted. Accordingly, the arms are also retracted so that the jet cutting tool can be moved to a new location and the arms redeployed for additional cutting. Advantageously, the retraction and the extension of the arms are fully repeatable such that the jet cutting tool can be used in multiple locations having multiple inner diameter, including cutting narrower portions of casing after cutting wider portions of casing.

In accordance with one aspect of the invention, one or more of the foregoing advantages have been achieved through a downhole jet cutting tool. The downhole jet cutting tool comprises a housing having an upper end for connection to a conduit string for running the downhole jet cutting tool into a well, the housing having a passageway for communicating a cutting fluid pumping down the conduit string to the downhole jet cutting tool; an actuating member operatively associated with the passageway whereby the actuating member is actuable by the cutting fluid, the actuating member having an initial position and a plurality of actuated positions; and a jet nozzle assembly, the jet nozzle assembly comprising an arm operatively associated with the actuating member whereby the arm is moved from a retracted position to one of a plurality of extended positions by the actuating member moving from the initial position to a corresponding actuated position, the arm having a cutting end and pivot end, the pivot end being pivotally connected to the housing, and the cutting end having a nozzle for expelling the cutting fluid, wherein the passageway of the housing and the nozzle of the cutting head are in fluid communication with each other such that the cutting fluid can flow from the passageway and out of the nozzle at a pressure sufficient to cut a cutting surface disposed within the well.

A further feature of the downhole jet cutting tool is that the cutting head may be pivotally connected to the arm. Another feature of the downhole jet cutting tool is that the housing may have an opening leading from the passageway to an exterior portion of the housing, and the arm may have a portion that extends through the opening into the passageway in engagement with the actuating member. An additional feature of the downhole jet cutting tool is that the passageway and the nozzle may be in fluid communication with each other through a flexible tubing. Still another feature of the downhole jet cutting tool is that the flexible tubing may be in fluid communication with the passageway through a port disposed in the housing above the actuating member. A further feature of the downhole jet cutting tool is that the housing may include a recess for receiving the jet nozzle assembly when the arm is in the retracted position. Another feature of the downhole jet cutting tool is that the actuating member may comprise a piston located in the passageway that is acted on by the cutting fluid flowing down the passageway. An additional feature of the downhole jet cutting tool is that the actuating member may include a biasing member for biasing the actuating member toward the initial position. Still another feature of the downhole jet cutting tool is that the biasing member may comprise a coil spring. A further feature of the downhole jet cutting tool is that the cutting head may include at least one standoff for contact with the cutting surface in the well while the arm is in one of the extended positions. Another feature of the downhole jet cutting tool is that at least one of the at least one standoffs may comprise a roller. An additional feature of the downhole jet cutting tool is that the roller may have an outer surface with at least one groove disposed on the outer surface. Still another feature of the downhole jet cutting tool is that at least one of the at least one standoffs may comprise a carbide dome button.

In accordance with another aspect of the invention, one or more of the foregoing advantages have been achieved a downhole jet cutting tool for cutting a tubular member in a well. The downhole jet cutting tool comprises a housing having an upper end for connection to a conduit string for lowering the housing into the tubular member, the housing having a passageway; a piston in the passageway for movement between upper and lower positions; a spring in the passageway for urging the piston toward the upper position; an arm having an upper portion pivotally connected to an exterior portion of the housing at a pivot point, the arm having a cam portion that extends through an opening in the housing into the passageway below the piston so that cutting fluid being pumped down the conduit string moves the piston downward from the upper position, causing the piston to push downward on the cam portion of the arm to pivot a lower portion of the arm outward from the housing; a cutting head with a nozzle attached to the lower portion of the arm for engaging the tubular member; and a flexible tube extending from a port in the housing above the piston to the cutting head for delivering cutting fluid being pumped down the conduit string to the nozzle.

In accordance with still another aspect of the invention, one or more of the foregoing advantages have been achieved a method of cutting a casing disposed within a well. The method comprising the steps of: (a) running a downhole jet cutting tool on a conduit string into a tubular member of a well to a first location, the downhole jet cutting tool having an actuating member biased toward an initial position and an arm with a cutting head, the arm being pivotally movable from a retracted position by movement of the arm from the initial position; (b) pumping a cutting fluid down the string, which exerts a force on the actuating member to move the actuating member from the initial position, causing the arm to pivot from the retracted position and move the cutting head outward into contact with a surface of the tubular member; (c) continuing to pump the cutting fluid down the string, which flows to and out of the cutting head, resulting in the tubular member being cut; and (d) after the tubular member has been cut, stopping the pumping of cutting fluid down the string, which allows the actuating member to return to its initial position and, thus, causing the arm to return to the retracted position.

A further feature of the method of cutting a casing disposed within a well is that the actuating member in step (a) may comprise a piston. Another feature of the method of cutting a casing disposed within a well is that the method may further comprise the step of moving the downhole jet cutting tool to a second location within the well after completion of step (d) and repeating steps (b) and (c). An additional feature of the method of cutting a casing disposed within a well is that the second location may be narrower than the first location. Still another feature of the method of cutting a casing disposed within a well is that step (a) may comprise pivotally mounting the arm to a housing of the jet cutting tool at a pivot point; and step (b) may comprise exerting a downward force by the actuating member on a portion of the arm inward from the pivot point.

The jet cutting tools and methods of cutting a surface in a wellbore disclosed herein have one or more of the following advantages: providing the capability of extending and retracting the jetting nozzles for easy and quick relocation and redeployment within a well; permitting the jetting nozzles to be consistently extended to the cutting surface; maintaining the jetting nozzles in the appropriate orientation during cutting; permitting easy and efficient cutting of casing when passing through a restriction in the casing or when cutting a surface in relatively shallow water depth; permitting efficient cutting in multiple locations within conduits having variable inner diameters; and providing the capability of cutting in large diameter conduits and then be redeployed for cutting in small diameter conduits without having to remove the tool from the wellbore.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

Figure 1:
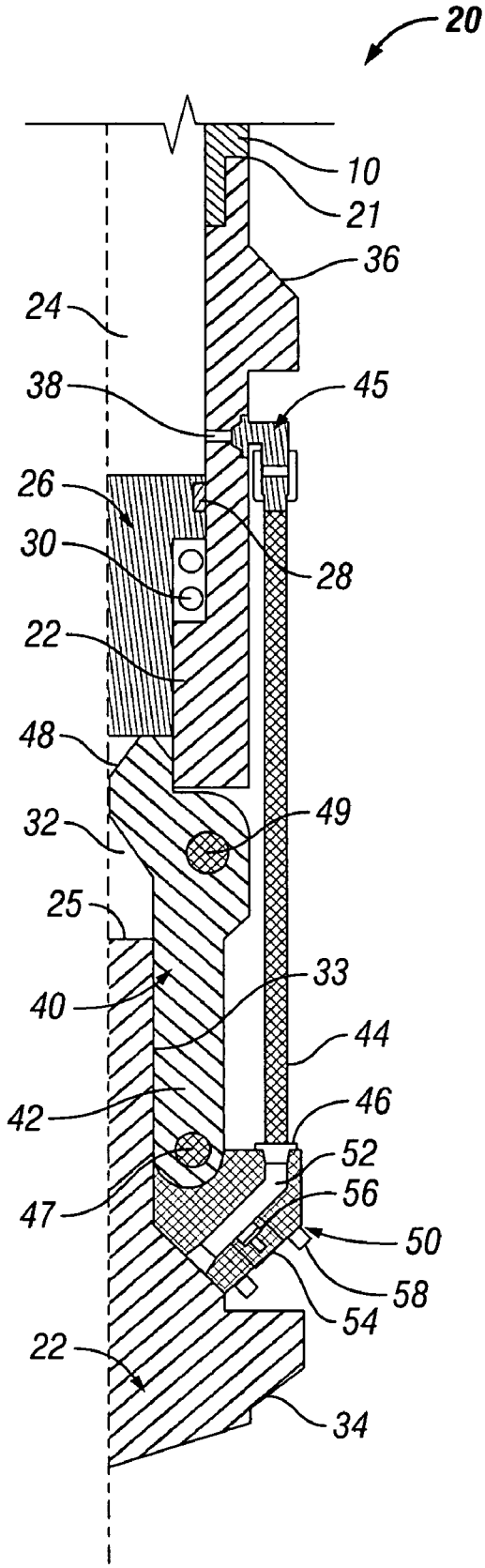
FIG. 1 is a cross-sectional view of one embodiment of the jet cutting tool of the present invention shown in its retracted or run-in position.
Figure 2:
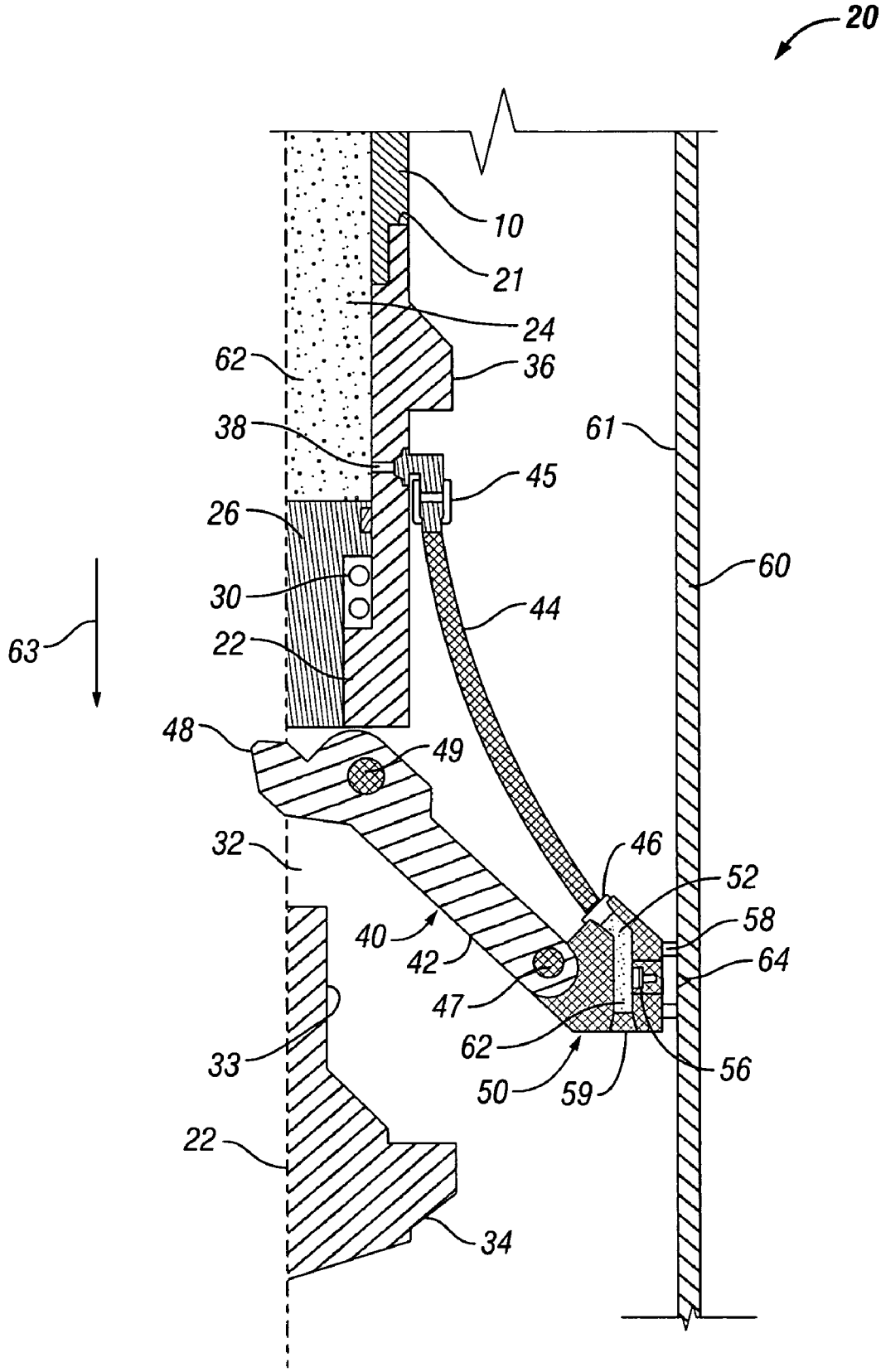
FIG. 2 is a cross-sectional view of the jet cutting tool illustrated in FIG. 1 shown in its extended or cutting position.

Referring now to FIGS. 1-2, jet cutting tool 20 is shown in its retracted or "run-in" position (FIG. 1) and an extended or cutting position (FIG. 2). Jet cuttingtool 20 has housing 22 with passageway 24 extending longitudinally into upper end 21 of housing 22. Upper end 21 is adapted to be connected to string of conduit 10, such as tubing or drill pipe, through any device or method known to persons of ordinary skill in the art. The lower portion of housing 22 is solid, with passageway 24 having a bottom 25 approximately midway along the length of housing 22.

Actuating member such as piston 26 is slidingly engaged within passageway 24 of housing 22. Resilient seal 28 provides a seal with piston 26 along the wall of passageway 24. Preferably, a retaining member such as coil spring 30 is disposed adjacent piston 26 for urging piston 26 upward. As discussed in greater detail below, spring 30 is expanded when jet cutting tool 20 is in its retracted position (FIG. 1) and compressed when jet cutting tool 20 is in its extended position (FIG. 2). Therefore, spring 30 is biased for retaining piston 26 in an initial or upper position in which jet cutting tool 20 is in its retracted position.

Housing 22 also includes a plurality of rectangular openings 32 (only one shown) extending through its side wall, into which part of a jet nozzle assembly 40 is received when jet cutting tool 20 is in its retracted position. Although only one jet nozzle assembly 40 is shown, typically tool 20 has three or more jet nozzle assemblies 40. Housing 22 also has a recess 33 on its exterior into which the remaining portion of jet nozzle assembly 40 locates. Opening 32 extends from passageway 24 to recess 33 and has a shorter axial length than recess 33. The lower end of opening 32 coincides with passageway bottom 25. Housing 22 also preferably includes radially extending flanges 34, 36 at its upper and lower ends for protecting jet nozzle assembly 40 when jet cutting tool 20 is in its retracted position.

Port 38, which is located above piston 26 in housing 22, provides fluid communication from passageway 24 to jet nozzle assembly 40. Jet nozzle assembly 40 comprises arm 42, tubing 44, and cutting head 50. Preferably, tubing 44 is flexible. Tubing 44 is in fluid communication with passageway 24 and cutting head 50. Couplings 45, 46 attach tubing 44 to passageway 24 and to cutting head 50, respectively. Preferably, cutting head 50 is pivotally attached to arm 42 by a fastener such as pin 47 or any other device that is capable of attaching cutting head 50 to arm 42 and allowing cutting head 50 to rotate or pivot relative to arm 42. Accordingly, cutting head 50 can pivot about the point of connection with arm 42 to facilitate better contact with the inner wall surface 61 of casing 60 (FIG. 2).

A pivot end of arm 42 is connected to housing 22 within the upper end of recess 33 by a fastener such as pin 49 or any other device that is capable of attaching the pivot end of arm 42 to housing 22 and allowing arm 42 to rotate or pivot about pivot pin 49. A lever or cam 48 is integrally formed on the upper end of arm 42 and extends through opening 32 into passageway 24 in contact with the lower end of piston 26. Cam 48 contacts piston 26 at a point that is radially inward and upward from pivot pin 49, creating a moment arm. Downward movement of piston 26 pushes downward on cam 48, causing arm 40 to pivot outward to the position shown in FIG. 2. Preferably, flanges 34, 36 protect arm 42, cutting head 50, and tubing 44 of jet nozzle assembly 40 when arm 42 is in its retracted position (FIG. 1). As shown in FIG. 1, in a preferred embodiment, tubing 44 has little or no slack in it when jet cutting tool 20 is in the retracted position. Therefore, the risk of tubing 44 being damaged or broken when jet cutting tool 20 is being run into the well is lessened.

Cutting head 50 has passage 52 disposed therein. Passage 52 is in fluid communication with coupling 46 and, thus, tubing 44 and passageway 24. Cutting head 50 also includes opening 54 with, nozzle 56. As shown in the embodiment of FIGS. 1 and 2, passage 52 in cutting head 50 includes plug 59. Plug 59 is used to close one end of passage 52 when passage 52 is formed by drilling all the way through cutting head 50. In other words, plug 59 may be included if certain methods of manufacturing cutting head 50 are utilized.

Figure 3:
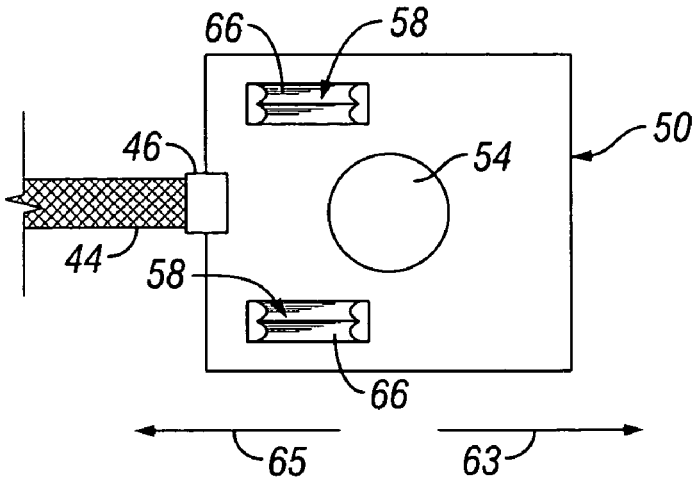
FIG. 3 is a top view of a cutting head of one specific embodiment of the jet cutting tool of the present invention.

Cutting head 50 also preferably includes one or more standoffs 58 that engage the wall surface of casing 60 (FIG. 2) and facilitate maintaining cutting head 50 and, thus, jet cutting tool 20 in place. Standoffs 58 preferably also provide guidance of cutting nozzle 56 in the same track. As shown in FIGS. 1 and 2, standoffs 58 may comprise dome buttons formed of a hard, wear resistant material such as tungsten carbide. In other embodiments, standoffs 58 are polymer elements. In still other embodiments, shown in FIGS. 3-5, standoffs 66 are bearing units such as rollers 58 having grooves 67 (shown in FIG. 5) to facilitate gripping the inner wall surface of casing 60.

Figure 4:
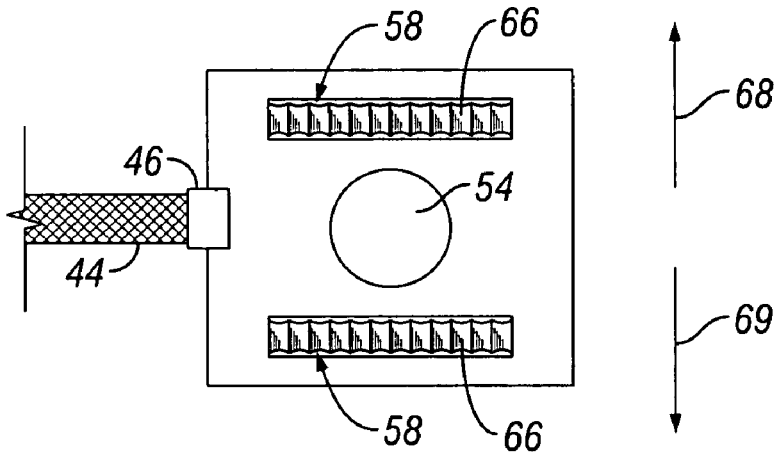
FIG. 4 is a top view of another cutting head of one specific embodiment of the jet cutting tool of the present invention.
Figure 5:
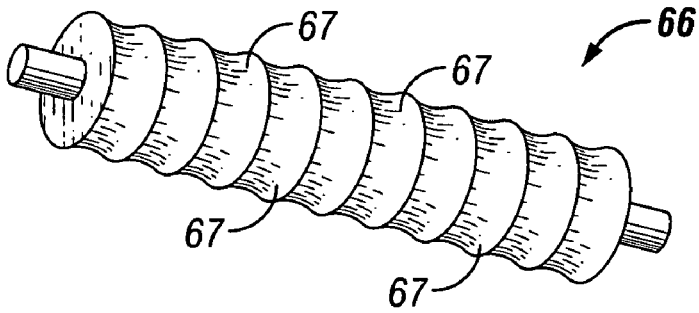
FIG. 5 is a perspective view of a roller for one embodiment of the jet cutting tools of the present invention.

Standoffs 58 may be arranged in any manner to facilitate the desired type of cut in casing 60. For example, as shown in greater detail in FIG. 3, standoffs 58 are rollers 66 for rolling axially along the inner wall surface of casing 60 (FIG. 2) in the direction of arrow 63 and arrow 65 when cutting tool 20 is making an axial cut. Alternatively, as shown in FIG. 4, rollers 66 may be rotated 90 degrees, i.e., perpendicular to rollers 66 shown in FIG. 3, such that they rotate and, thus, cut, in the direction of arrows 68 and 69 when cutting tool 20 is making a circumferential cut. In one specific embodiment, standoffs 58 are ball bearings (not shown) capable of rotating in any direction.

As mentioned above, FIG. 1 shows jet cutting tool 20 in its initial or "run-in" position. Each arm 42 is retracted and disposed along housing 22. After jet cutting tool 20 is properly placed within casing 60 of the well (not shown), cutting fluid 62 (FIG. 2) is pumped down conduit string 10 through passageway 24 of jet cutting tool 20. Cutting fluid 62 forces piston 26 to move downward, i.e., in the direction of arrow 63. In so doing, spring 30 is compressed and piston 26 pushes on cam end 48 and rotates arm 42 around or about pivot pin 49, causing arm 42 to extend outwardly from housing 22 until standoffs 58 of cutting head 50 contact the inner wall surface of casing 60 as illustrated in FIG. 2. Thus, jet cutting tool 20 is placed in its extended or cutting position.

After cutting head 50 contacts the inner wall surface of casing 60, piston 26 can no longer move in the direction of arrow 63. Therefore, cutting fluid 62 is forced at a greater pressure through tubing 44 to cutting head 50 where it is focused through passage 52 into and through nozzle 56 and out of opening 54 at a high pressure to cut the inner wall of casing 60 as illustrated by cut 64 (FIG. 2). The operator moves conduit string axially to form an axial cut and rotates conduit string 10 to form a circumferential cut. In one specific embodiment (not shown), cutting fluid 62 propels a rotatable cutting member (not shown) to facilitate cutting of the inner wall surface of casing 60. In other embodiments, all of the cutting is performed by cutting fluid 62 being expelled through nozzle 56 at a high pressure.

Cutting fluids 62, and their cutting rates, are known to persons skilled in art. Preferably, cutting fluid 62 is an abrasive cutting fluid such as those having a ratio of 1 pound of abrasive material per gallon of water carrier. Suitable abrasive materials are known in the art such as ground garnet material which is available from many known sources. The water in cutting fluid 62 can be enhanced with polymers to increase the stream holding profile of the cutting fluid 62 to increase cutting efficiency. Typical cutting rates, but by no means the only cutting rates, are expected to be approximately 1 inch per minute using the foregoing cutting fluid 62.

After casing 60 has been cut as desired by the operator of jet cutting tool 20, the operator ceases pumping cutting fluid 62 down conduit string 10. Accordingly, the force being applied to piston 26 in the direction of arrow 63 ceases. When this occurs, spring 30 expands and, thus, moves piston 26 upward in the opposite direction of arrow 63. The weight of jet nozzle assembly 40 causes arm 42 to rotate or pivot about cam end 48 until jet nozzle assembly 40 is received within recess 33 of housing 22. In other words, the removal of the pressure of cutting fluid 62 flowing through passageway 24 of jet cutting tool 20 causes jet cutting tool 20 to return to its run-in position. Subsequently, jet cutting tool 20 can be moved to a new location for additional cutting. Advantageously, the new location can have a smaller diameter and jet cutting tool 20 will properly deploy without the need for removal of jet cutting tool 20 from the well.

It is to be understood that the invention is not limited to the exact details of construction, operation, exact materials, or embodiments shown and described, as modifications and equivalents will be apparent to one skilled in the art. For example, the cutting head is shown as having a rectangular or square shape; however, cutting head can have any shape desired or necessary for providing the type of cut desired by the operator of the jet cutting tool. Likewise, the arm of the jet nozzle assembly and its corresponding recess can have any shape desired or necessary to permit extension and retraction as described above. Moreover, the tubing can be made of any material desired or necessary to facilitate transportation of the cutting fluid from the passageway to the cutting head. Additionally, the size of the opening from the passageway to the tubing, the size of the tubing, the size of the passageway in the cutting head, the size of the nozzle, and the size of the opening in the cutting head can be any size desired or necessary to provide the desired size and depth of cut in the casing. Further, the cutting surface is not limited to casing. Other types of conduits, tubings, or structures may be cut using the jet cutting tools described herein. In addition, spring can be replaced by a pressurized chamber or another device that is biased toward keeping the piston in the retracted position. Alternatively, hydrostatic pressure could provide the force for biasing the piston toward the retracted position by having the passageway in the housing continuing to the end of the jet cutting tool where it is opened to the wellbore. Moreover, the piston may be replaced with a valve or other actuating member known to persons of ordinary skill in the art. Additionally, the tubing may be inflexible and the couplings of the tubing to the housing and the cutting head may be flexible joints providing 360 degree movement. Further, a top sub may be connected to and placed in communication with the passageway of the housing and the tubing may be in fluid communication with the passageway of the housing through a port in the top sub instead of through a port in the housing. Additionally, a ported collar in fluid communication with the tubing may be secured to the exterior of the top sub to place the tubing in fluid communication with the port in the top sub and, thus, in fluid communication with the passageway. Accordingly, the invention is therefore to be limited only by the scope of the appended claims.

What is claimed is:

1. A downhole jet cutting tool comprising:

a housing having an upper end for connection to a conduit string for running the downhole jet cutting tool into a well; the housing having a passageway for communicating a cutting fluid pumping down the conduit string to the downhole jet cutting tool;

an actuating member operatively associated with the passageway whereby the actuating member is actuatable by the cutting fluid, the actuating member having an initial position and a plurality of actuated positions and actuation of the actuating member comprises the actuating member moving axially along a length of the passageway; and a jet nozzle assembly, the jet nozzle assembly comprising an arm operatively associated with the actuating member whereby the arm is moved from a retracted position to one of a plurality of extended positions by the actuating member moving from the initial position to a corresponding actuated position, the arm having a cutting end and pivot end, the pivot end being pivotally connected to the housing, and the cutting end comprising a cutting head having a nozzle for expelling the cutting fluid, wherein the passageway of the housing and the nozzle of the cutting head are in fluid communication with each other such that the cutting fluid can flow from the passageway and out of the nozzle at a pressure sufficient to cut a cutting surface disposed within the well.

2. The downhole jet cutting tool of claim 1, wherein the cutting head is pivotally connected to the arm.

3. The downhole jet cutting tool of claim 1, wherein the housing has an opening leading from the passageway to an exterior portion of the housing, and the arm has a portion that extends through the opening into the passageway in engagement with the actuating member.

4. The downhole jet cutting tool of claim 1, wherein the passageway and the nozzle are in fluid communication with each other through a flexible tubing.

5. The downhole jet cutting tool of claim 4, wherein the flexible tubing is in fluid communication with the passageway through a port disposed in the housing above the actuating member.

6. The downhole jet cutting tool of claim 1, wherein the housing includes a recess for receiving the jet nozzle assembly when the arm is in the retracted position.

7. The downhole jet cutting tool of claim 1, wherein the actuating member comprises a piston located in the passageway that is acted on by the cutting fluid flowing down the passageway.

8. The downhole jet cutting tool of claim 7, wherein the actuating member includes a biasing member for biasing the actuating member toward the initial position.

9. The downhole jet cutting tool of claim 8, wherein the biasing member comprises a coil spring.

10. The downhole jet cutting tool of claim 1, wherein the cutting head includes at least one standoff for contact with the cutting surface in the well while the arm is in one of the extended positions.

11. The downhole jet cutting tool of claim 10, wherein at least one of the at least one standoffs comprises a roller.

12. The downhole jet cutting tool of claim 11, wherein the roller has an outer surface with at least one groove disposed on the outer surface.

13. The downhole jet cutting tool of claim 10, wherein at least one of the at least one standoffs comprises a carbide dome button.

14. A downhole jet cutting tool for cutting a tubular member in a well, comprising:

a housing having an upper end for connection to a conduit string for lowering the housing into the tubular member, the housing having a passageway;

a piston in the passageway for movement between upper and lower positions;

a spring in the passageway for urging the piston toward the upper position;

an arm having an upper portion pivotally connected to an exterior portion of the housing at a pivot point, the arm having a cam portion that extends through an opening in the housing into the passageway below the piston so that cutting fluid being pumped down the conduit string moves the piston downward from the upper position, causing the piston to push downward on the cam portion of the arm to pivot a lower portion of the arm outward from the housing;

a cutting head with a nozzle attached to the lower portion of the arm for engaging the tubular member; and a flexible tube extending from a port in the housing above the piston to the cutting head for delivering cutting fluid being pumped down the conduit string to the nozzle.

15. A method of cutting a casing disposed within a well, the method comprising the steps of:

(a) running a downhole jet cutting tool on a conduit string into a tubular member of a well to a first location, the downhole jet cutting tool having an actuating member biased toward an initial position and an arm with a cutting head, the arm being pivotally movable from a retracted position by movement of the actuating member from the initial position;

(b) pumping a cutting fluid down the string, which exerts a force on the actuating member to move the actuating member from the initial position, causing the arm to pivot from the retracted position and move the cutting head outward into contact with a surface of the tubular member;

(c) continuing to pump the cutting fluid down the string, which flows to and out of the cutting head, resulting in the tubular member being cut; and (d) after the tubular member has been cut, stopping the pumping of cutting fluid down the string, which allows the actuating member to return to its initial position and, thus, causing the arm to return to the retracted position.

16. The method of claim 15, wherein the actuating member in step (a) comprises a piston.

17. The method of claim 15, further comprising:

moving the downhole jet cutting tool to a second location within the well after completion of step (d) and repeating steps (b) and (c).

18. The method of claim 17, wherein the second location is narrower than the first location.

19. The method of claim 15, wherein:

step (a) comprises pivotally mounting the arm to a housing of the jet cutting tool at a pivot point; and step (b) comprises exerting a downward force by the actuating member on a portion of the arm inward from the pivot point.

* * * * *